US011325225B2

(12) United States Patent
Hu

(10) Patent No.: US 11,325,225 B2
(45) Date of Patent: May 10, 2022

(54) RECIPROCATING WRENCH FOR QUICK COMBINING FASTENER

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 231 days.

(21) Appl. No.: 16/662,398

(22) Filed: Oct. 24, 2019

(65) Prior Publication Data

US 2020/0406431 A1 Dec. 31, 2020

(30) Foreign Application Priority Data

Jun. 28, 2019 (TW) ..... 108122742

(51) Int. Cl.

| | |
|---|---|
| ***B25B 13/32*** | (2006.01) |
| ***B25B 13/38*** | (2006.01) |
| ***B25B 13/46*** | (2006.01) |
| ***B25B 13/50*** | (2006.01) |

(52) U.S. Cl.

CPC ..... *B25B 13/32* (2013.01); *B25B 13/38* (2013.01); *B25B 13/46* (2013.01); *B25B 13/505* (2013.01)

(58) Field of Classification Search

CPC ..... B25B 13/46; B25B 13/481; B25B 13/32; B25B 13/38; B25B 13/505; B25B 13/50

USPC ..... 81/98, 90.1, 90.3, 90.7, 90.8, 120, 65.2, 81/DIG. 8

See application file for complete search history.

(56) References Cited

U.S. PATENT DOCUMENTS

| | | | | |
|---|---|---|---|---|
| 6,978,701 | B1 | 12/2005 | Buchanan | |
| 9,884,409 | B2 | 2/2018 | Yang et al. | |
| 2006/0144197 | A1* | 7/2006 | Choi | B25B 13/46 81/98 |
| 2018/0117741 | A1* | 5/2018 | Hsu | B25B 13/46 |
| 2021/0122012 | A1* | 4/2021 | Buchanan | B25B 13/04 |

FOREIGN PATENT DOCUMENTS

| | | |
|---|---|---|
| WO | 2018/167520 | 9/2018 |

* cited by examiner

*Primary Examiner* — Orlando E Aviles
*Assistant Examiner* — Thomas Raymond Rodgers
(74) *Attorney, Agent, or Firm* — WPAT, PC

(57) ABSTRACT

A reciprocating wrench for quick combining fastener includes a main body, a claw, and an elastic positioning device therebetween. The main body includes a concavely-shaped first jaw opening, which has a pivot end at an end thereof. The claw includes a concavely-shaped second jaw opening, which has a pivotal combination portion at an end thereof. The pivotal combination portion is pivotally connected with the pivot end, such that the claw and the main body pivotally move with respect to each other. The elastic positioning device allows the claw to optionally rotate toward a closing direction or remain in the opening status. Therefore, the claw is able to remain in the opening status for combining the fastener.

14 Claims, 14 Drawing Sheets

RECIPROCATING WRENCH FOR QUICK COMBINING FASTENER

BACKGROUND OF THE INVENTION

1. Field of the Invention

The present invention relates to reciprocating wrenches, and more particularly, to a reciprocating wrench for quick combining fastener.

2. Description of the Related Art

As shown by the wrench of U.S. Pat. No. 6,978,701, the head portion thereof has a ring component, such that the ring component is mounted around a hexagonal nut. However, when the hexagonal nut is to be fastened, after driving the nut to rotate in clockwise by 60 degrees through the wrench, the user needs to detach the wrench from the hexagonal nut along the axial direction of the nut, rotates the wrench in counterclockwise by 60 degrees, re-mounts the ring component around the nut, and repeats the aforementioned wrenching operations. Such operations are time costing, and such type of wrench is not categorized under a quick operative wrench.

Also, as shown by WO2018/167520A1 "LINE WRENCH HEADS AND LINE WRENCHES", a line wrench includes a wrench head, a fixed head portion, and a pivoting head portion, wherein the pivoting head portion pivotally moves to open with respect to the fixed head portion. Further, a resilient portion is disposed between the wrench head and the pivoting head portion, such that the pivoting head portion is maintained at a closing position with respect to the fixed head portion. Therefore, the line wrench is able to be efficiently engaged with a hexagonal fastener on an oil-pipe through the pivoting operation of the pivoting head portion with respect to the fixed head portion, thereby screwing the hexagonal fastener. However, such oil-pipe wrench applies the function of the resilient portion, so that the fixed head portion and the pivoting head portion are normally closed with respect to each other. Therefore, when the wrench is applied, the user needs to press the pivoting head portion by fingers, and then release the fingers for the pivoting head portion to be recovered to the original position when the oil-pipe enters the operation range of the pivoting head portion. During such operation processes, based on the fact that the fingers of the user being closed to the wrench head, the operation is easily hindered in a relatively narrow working space, and the wrench is kept from entering the peripheral range of the oil-pipe for combining the fastener for operation. Further, in a high temperature oil-pipe operating environment, the user may suffer a hand burnt accident when trying to press the pivoting head portion.

In addition, U.S. Pat. No. 9,884,409 discloses an oil-pipe wrench, wherein the pivotal member thereof has a distal end inserted in the second recess during the fastening process of the hexagonal object. For facilitating the function, two separate pivots (first and second locking members) are required, such that the pivotal members have two different pivot centers, so as to remove the distal end of the pivotal member from the second recess. However, such design increases the structural complexity and the cost thereof, which is still not optimal. Similarly, such wrench is easily hindered in the operation in a relatively narrow working space, so as to be kept from entering the peripheral range of the oil-pipe for combining the fastener for operation. Also, in a high temperature oil-pipe operating environment, the user may suffer a hand burnt accident when trying to press the pivoting head portion.

Based on the aforementioned reasons, the applicant develops a reciprocating wrench for quick combining the fastener for providing a convenience of safe usage and operation of the wrench.

SUMMARY OF THE INVENTION

For improving the issues above, a reciprocating wrench for quick combining fastener is disclosed. With the claw which is able to be kept opening, the user is able to insert the wrench into the peripheral range of the oil-pipe for combining the fastener for carrying out the wrenching operation without the need to press the claw, so as to overcome the space limitation and achieve the convenience of operation.

For achieving the aforementioned objectives, a reciprocating wrench for quick combining fastener in accordance with an embodiment of the present invention is provided, comprising a main body, a claw, and an elastic positioning device. The main body has a concavely-shaped first jaw opening, which has a pivot end on one side thereof. The claw has a concavely-shaped second jaw opening, which has a pivotal combination portion on one side thereof. The pivotal combination portion of the claw is pivotally connected with the pivot end of the main body along a pivot center, such that the claw is allowed to pivotally rotate with the pivot center as the rotation center in order to rotate toward a closing direction or an opening direction. The elastic positioning device is disposed between the main body and the claw, so that the claw is allowed to optionally rotate toward the closing direction or the opening direction.

With such configuration, the claw of the present invention does not need to be continuously pressed for maintaining the opening status, such that the wrench is easily inserted into the peripheral range of the fastener for combining the fastener to carry out the wrenching operation, without being limited by the narrow operation space. Also, the requirement and inconvenience of continuously pressing the claw are saved, and the operation safety of the user is assured.

DETAILED DESCRIPTION OF THE INVENTION

Figure 1:
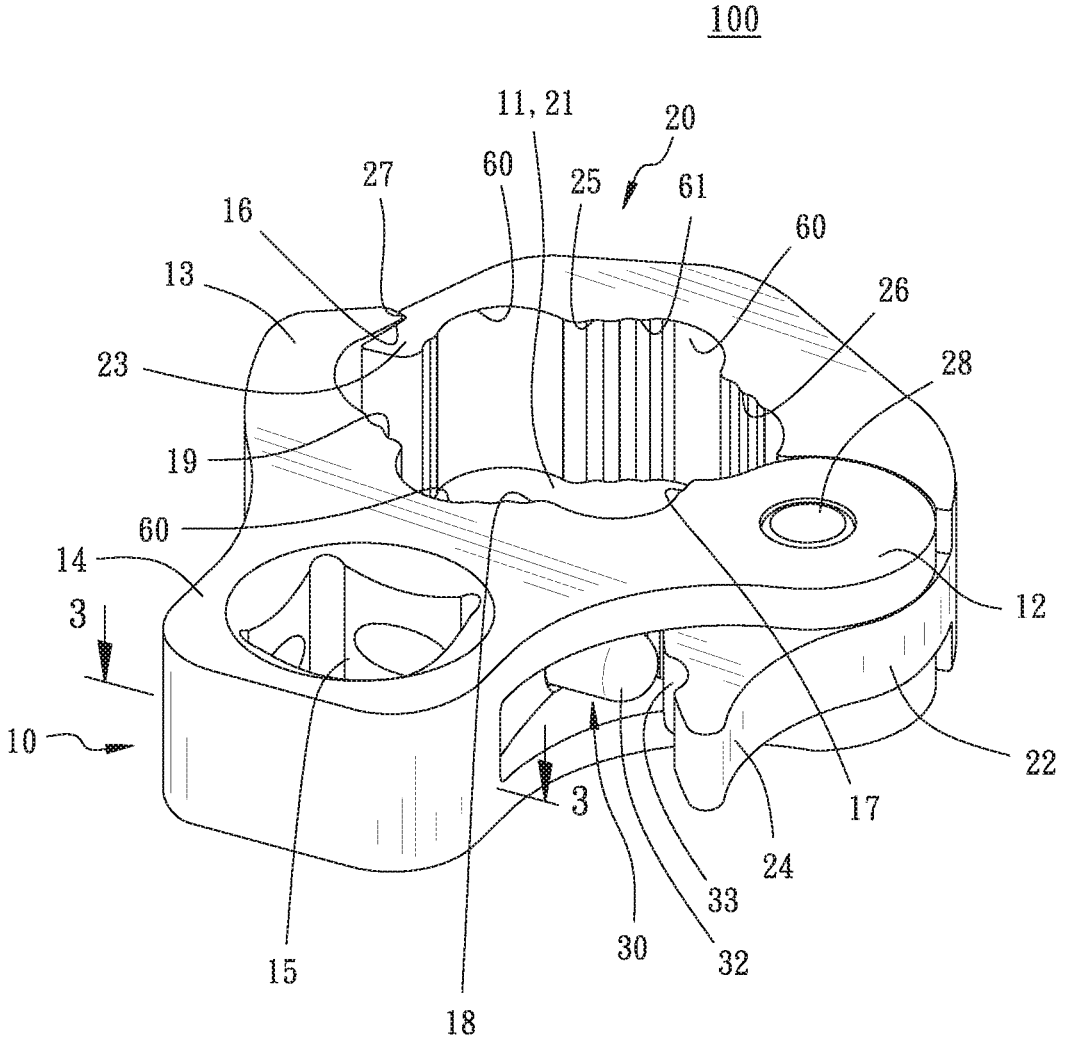
FIG. 1 is a perspective view of the reciprocating wrench for quick combining fastener in accordance with a first embodiment of the present invention.
Figure 2:
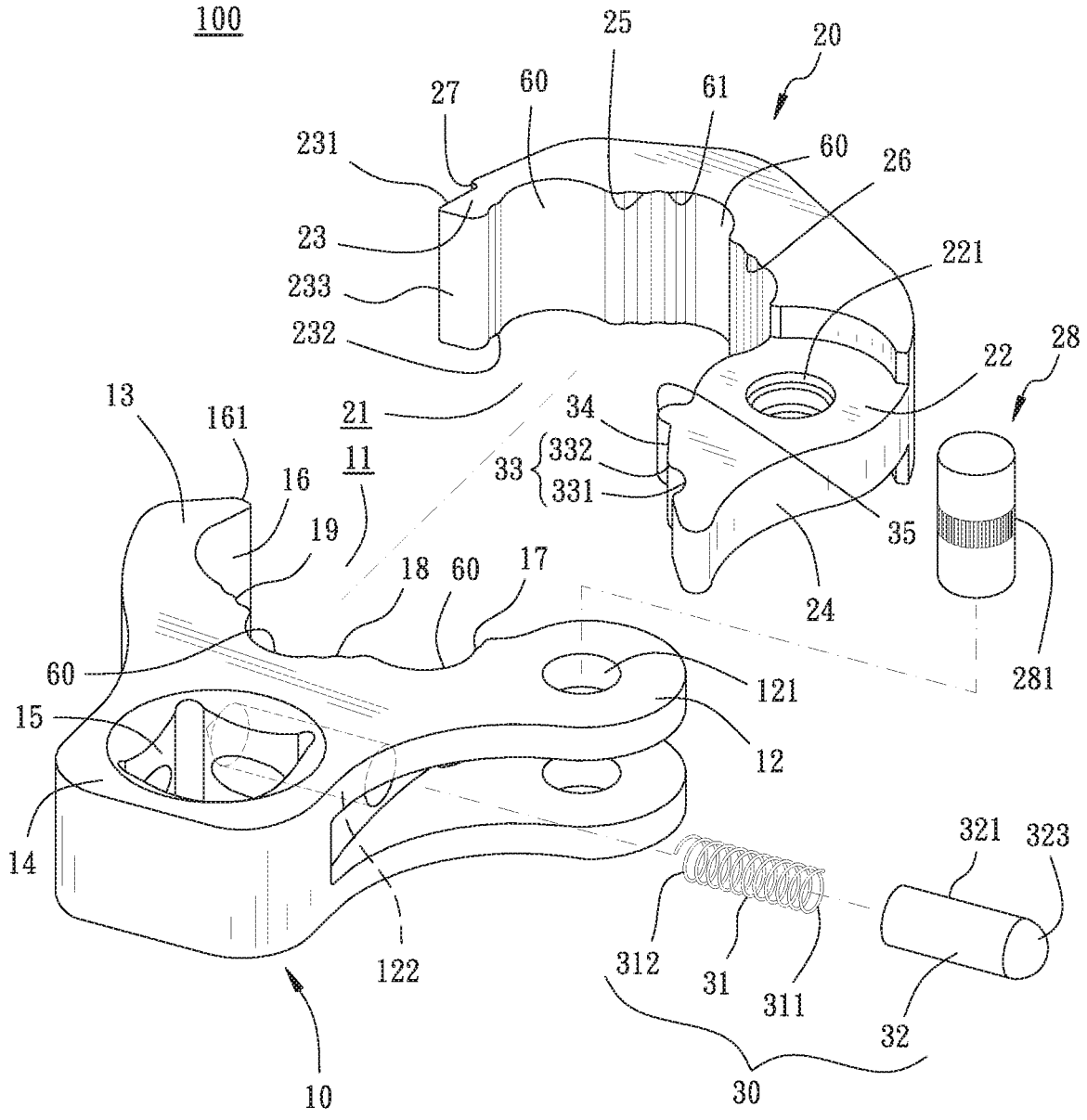
FIG. 2 is an exploded view of the reciprocating wrench for quick combining fastener in accordance with the first embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion. Embodiments of the present invention are illustrated in detail along with the drawings. However, the technical features included by the present invention are not limited to certain embodiments hereby provided. Scope of the present invention shall be referred to the claims, which include all the possible replacements, modifications, and equivalent features.

Referring to FIG. 1 to FIG. 11, a reciprocating wrench 100 for quick combining fastener 50 in accordance with a first embodiment of the present invention is provided, comprising a main body 10, a claw 20, and an elastic positioning device 30.

The main body 10 has a concavely-shaped first jaw opening 11. The first jaw opening 11 has a pivot end 12 on one side and a first tip 13 on another side in opposite to the pivot end 12.

Figure 4:
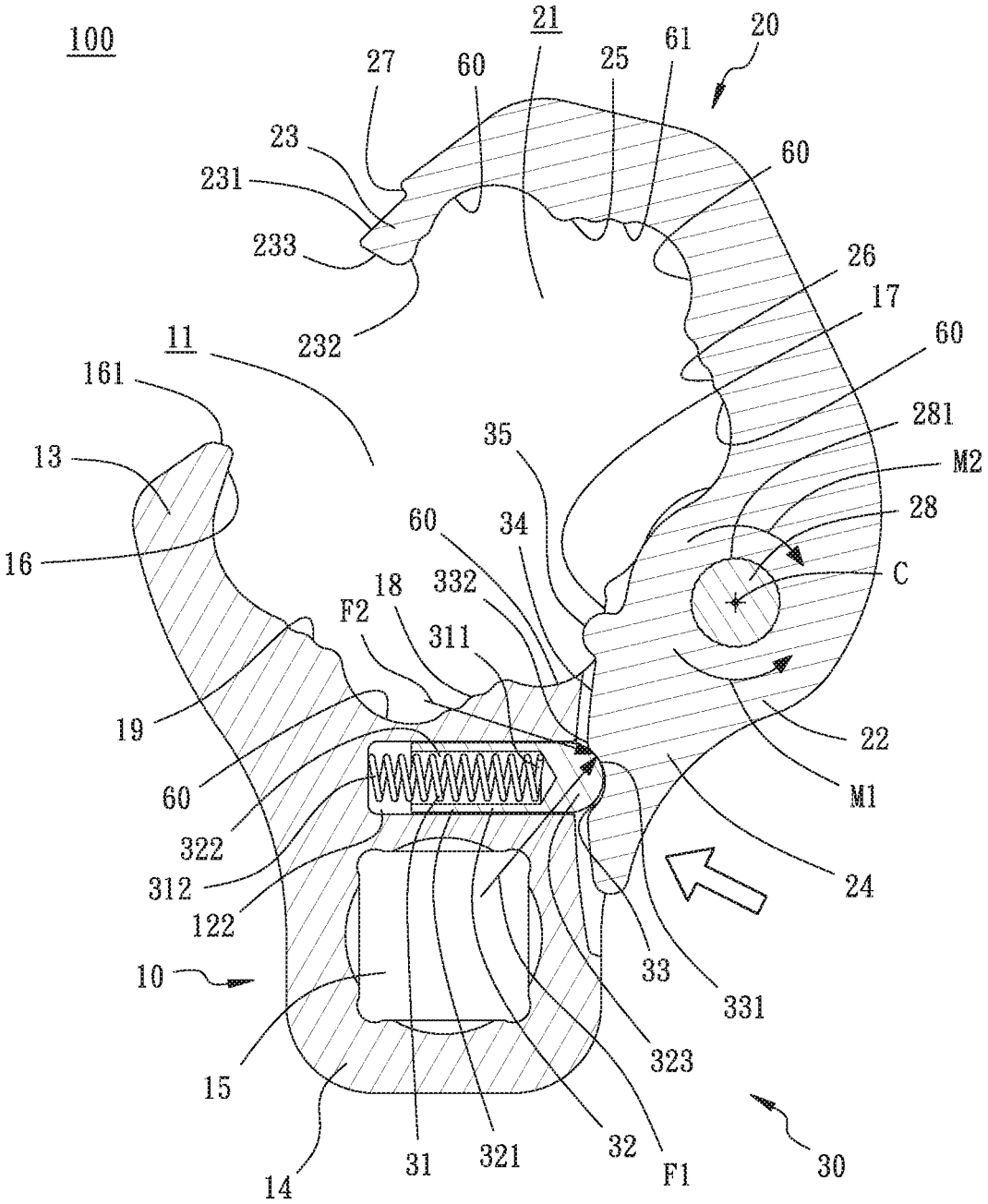
FIG. 4 is a transverse sectional view of the reciprocating wrench for quick combining fastener in accordance with the first embodiment of the present invention, illustrating the claw at the first position and opening with respect to the main body before combining the fastener.

The claw 20 has a concavely-shaped second jaw opening 21. The second jaw opening 21 has a pivotal combination portion 22 on one side and a second tip 23 on another side in opposite to the pivotal combination portion 22. The pivotal combination portion 22 of the claw 20 is pivotally connected with the pivot end 12 of the main body 10 along a pivot center C, such that the claw 20 is allowed to pivotally rotate with the pivot center C as the rotation center X in order to rotate toward a closing direction or an opening direction. The claw 20 and the main body 10 are allowed to pivotally move between a first position and a second position with respect to each other. As shown by FIG. 4, when the claw 20 is at the first position, the claw 20 remains opening with respect to the main body 10.

The elastic positioning device 30 is disposed between the main body 10 and the claw 20, and the claw 20 is able to rotate toward the closing direction or optionally remained open. In the opening status, the wrench 100 is applied for combining the fastener 50. As shown by FIG. 5 to FIG. 11, the wrench 100 is allowed to be engaged with the fastener 50, such as the one being disposed on an oil-pipe, so that the fastener 50 is screwed to be fastened or loosened.

The fastener 50 is a hexagonal thread bolt, wherein a hexagonally-shaped head portion thereof has a first force bearing face 51A to a sixth force bearing face 56A sequentially disposed in a counterclockwise direction from the 9 o'clock direction. Similarly, the fastener 50 has a first obverse force bearing face 51B to a sixth obverse force bearing face 56B sequentially disposed. The wrench 100 is engaged with the fastener 50 and wrenches the fastener 50 along a rotation center X, wherein the rotation center X is the axle of the fastener 50.

When the wrench 100 is engaged with the fastener 50 for carrying out the fastening operation, the fastener 50 is positioned in the first jaw opening 11 and the second jaw opening 21.

Figure 3:
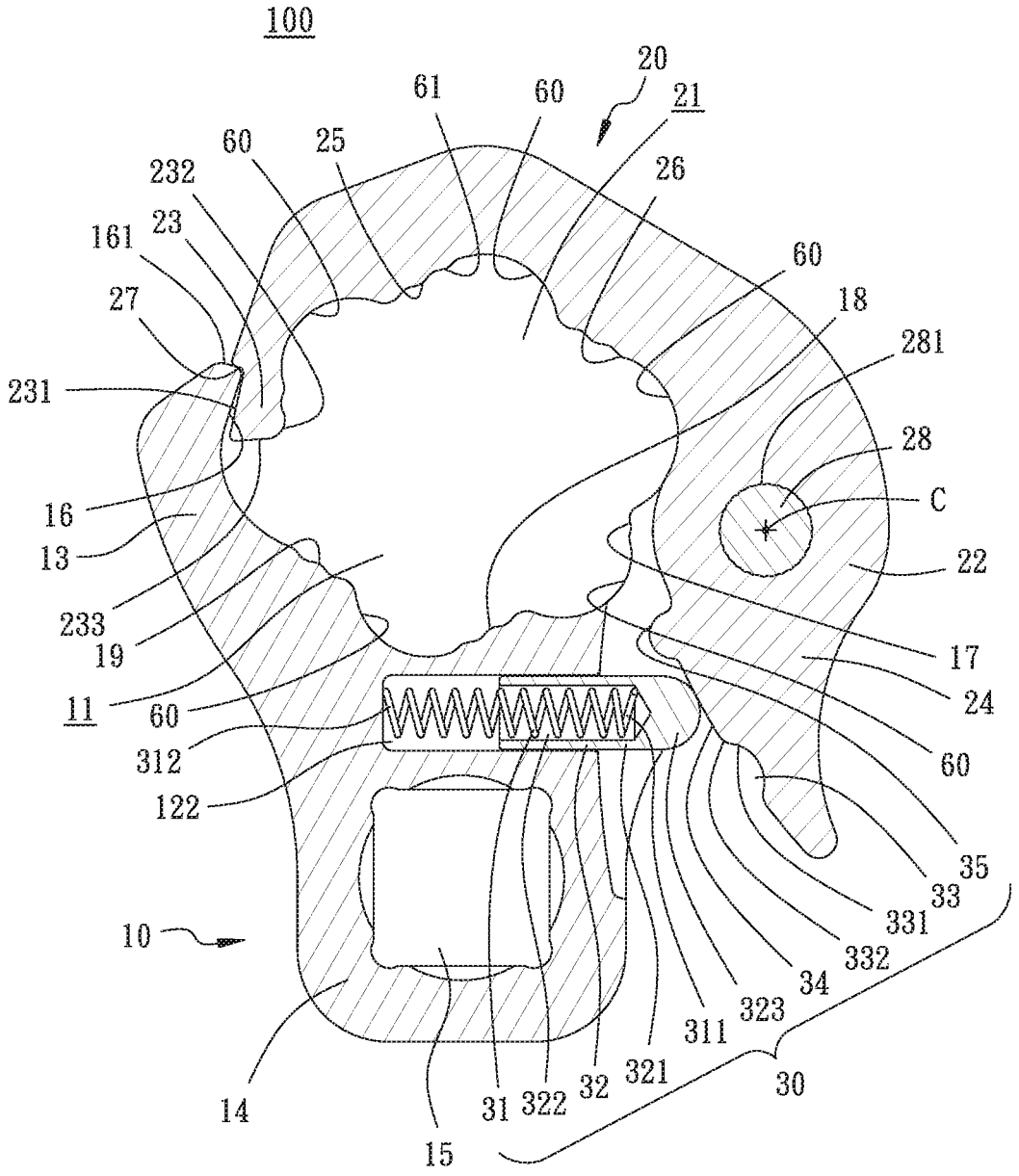
FIG. 3 is a sectional view of the reciprocating wrench for quick combining fastener, illustrating the wrench at the normal position with the claw facing the closing direction.
Figure 8:
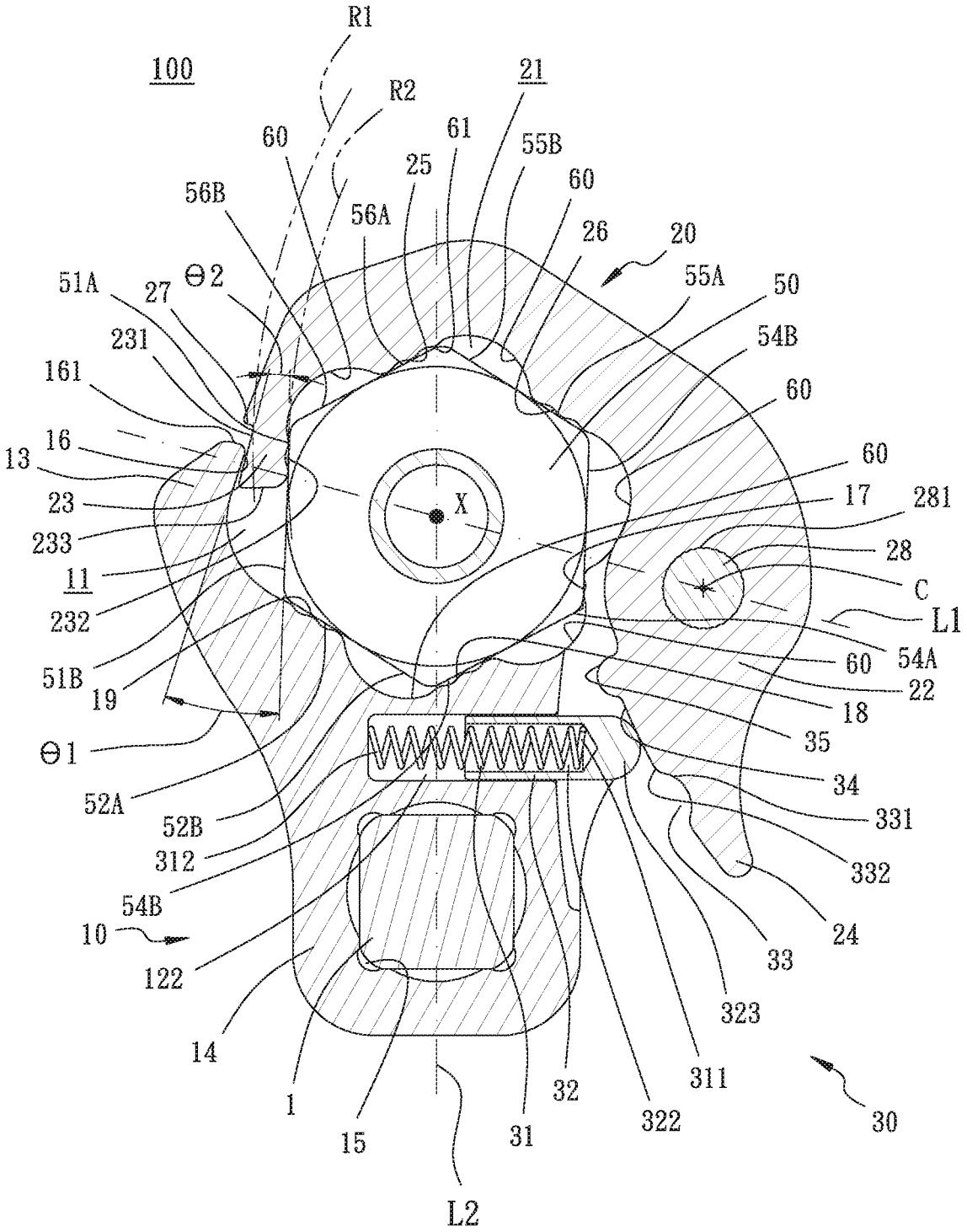
FIG. 8 is a transverse sectional view of the reciprocating wrench for quick combining fastener, illustrating the claw at the second position in the closing status with respect to the main body and completely combining the fastener.

The first tip 13 has a block face 16. The first jaw opening 11 of the main body 10 further has a first forcing face 17, a second forcing face 18, and a third forcing face 19 sequentially disposed in a clockwise direction on one side of the block face 16, as shown by FIG. 3 and FIG. 8. When the wrench 100 is engaged with the fastener 50, the block face 16 faces the claw 20; the first forcing face 17, the second forcing face 18, and the third forcing face 19 face the fourth force bearing face 54A, the third force bearing face 53A, and the second force bearing face 52A of the fastener 50, respectively. Therefore, when the wrench 100 is engaged with the fastener 50, the main body 10 correspondingly surrounds the three force bearing faces of the fastener 50.

The pivotal combination portion 22 of the claw 20 is pivotally connected with the pivot end 12 of the main body 10 through a single trunnion 28 along the pivot center C, such that the claw 20 and the main body 10 are able to pivotally move with respect to each other. The pivot end 12 of the main body 10 includes two pivot ears spaced with each other, and each pivot ear comprises a first pivot hole 121, respectively. The claw 20 comprises a second pivot hole 221. The trunnion 28 passes through the first pivot holes 121 and the second pivot hole 221 along the pivot center C, such that the claw 20 is pivotally connected with the main body 10. The trunnion 28 has a tooth portion 281 formed on the middle section thereof, wherein the outer diameter of the tooth portion 281 is larger than the inner diameter of the second pivot hole 221, such that the second pivot hole 221 of the pivotal combination portion 22 is fittingly engaged with the tooth portion 281. Therefore, when the trunnion 28 is disposed between the main body 10 and the claw 20, the trunnion 28 is fixed in the second pivot hole 221.

The main body 10 has an operation portion 14 formed on a position away from the first jaw opening 11. In the first embodiment, the operation portion 14 of the main body 10 comprises a combination bore 15, and the central line of the combination bore 15 passes through the main body 10 and is arranged in parallel to the rotation center X. The combination bore 15 of the main body 10 is combined with the driving end of a hand tool 1, so that the user wrenches the hand tool 1 to drive the fastener 50 through the main body 10. Therein, the hand tool 1 is a handle.

In addition, a press member 24 extends to be formed on the pivotal combination portion 22 of the claw 20, such that the user is able to press the press member 24 for opening the claw 20 with respect to the main body 10.

The second tip 23 has a shape gradually widening toward the distal end of the claw 20. The second tip 23 includes an outer retaining face 231 and an opposite inner retaining face 232. The longest distance between the outer retaining face 231 and the pivot center C is a first radius R1, and the shortest distance between the inner retaining face 232 and the pivot center C is a second radius R2, wherein the first radius R1 is larger than the second radius R2. Notably, when the claw 20 pivotally sways, the claw 20 pivotally moves with respect to the main body 10 along the first radius R1 and the second radius R2. When the claw 20 is at the second position and the wrench 100 is not engaged with the fastener 50, the first radius R1 is smaller than the shortest distance between the first tip 13 and the pivot center C. When the wrench 100 is engaged with the fastener 50 for carrying out the fastening operation, the wrench 100 easily drives the fastener 50 to rotate.

The wrench 100 of the present invention comprises a first imaginary line L1 and a second imaginary line L2. As shown by FIG. 8, when the wrench 100 is engaged with the fastener 50, the first imaginary line L1 passes through the pivot center C, the rotation center X of the fastener 50, the second tip 23, and the first tip 13. The second imaginary line L2 passes through the first imaginary line L1 and the rotation center X. An outer side of the block face 16 is connected with a first connection face 161, with a second connection face 233 formed between and connecting the outer retaining face 231 and the inner retaining face 232.

When the wrench 100 is engaged with the fastener 50, the block face 16 faces the outer retaining face 231 of the claw 20, and the first forcing face 17, the second forcing face 18, and the third forcing face 19 face the fourth force bearing face 54A, the third force bearing face 53A, and the second force bearing face 52A of the fastener 50, respectively. The inner retaining face 232 faces the first force bearing face 51A of the fastener 50. Further, the claw 20 comprises a fourth forcing face 25 and a fifth forcing face 26, which face the sixth force bearing face 56A and a fifth force bearing face 55A of the fastener 50, respectively, such that the claw 20 surrounds the other three force bearing faces of the fastener 50. Meanwhile, a first inclination angle θ1 is included by the block face 16 and the first force bearing face 51A, and a second inclination angle θ2 is included by the outer retaining face 231 and the first force bearing face 51A. The second inclination angle θ2 is smaller than the first inclination angle θ1.

In addition, a plurality of concaves 60 are disposed on the inner edge of the first jaw opening 11 and the second jaw opening 21 for facing a second obverse force bearing face 52B, a third obverse force bearing face 53B, a fourth obverse force bearing face 54B, a fifth obverse force bearing face 55B, and a sixth obverse force bearing face 56B of the fastener 50, respectively, such that the concaves 60 are able to face the five corners of the fastener 50 in the engagement of the wrench 100 and the fastener 50. Therefore, during the wrenching process, the corners of the fastener 50 are prevented from overly worn. The fourth forcing face 25, fifth forcing face 26, and the inner retaining face 232 comprise a plurality of skid proof grooves 61, respectively, for preventing the skidding against the fastener 50. Further, in the first embodiment of the present invention, each of the first forcing face 17, the second forcing face 18, and the third forcing face 19 has a plurality of skid proof grooves 61, respectively, for achieving a skid proof function.

The elastic positioning device 30 includes an elastic member 31, a positioning member 32, and a positioning area 33 which is formed on the claw 20. The elastic member 31 is disposed on the main body 10 and provides the elastic recovering force for the claw 20 to rotate toward the closing direction. The positioning member 32 is disposed between the main body 10 and the claw 20, and optionally resists against the positioning area 33, such that the claw 20 optionally remains in the opening status. The positioning area 33 includes a positioning face 331 and a dividing side 332 disposed on one side of the positioning face 331. The distance from the positioning face 331 to the pivot center C is smaller than the distance from the dividing side 332 to the pivot center C. A slide area 34 is formed on one side of the positioning area 33, so as to be pushed by the elastic member 31 and slide with respect to the positioning member 32. At the first position, the positioning member 32 of the elastic positioning device 30 resists against the positioning area 33. The main body 10 has an installation notch 122 formed on the pivot end 12 and facing the claw 20. The elastic member 31 is disposed in the installation notch 122 and pushes the positioning member 32. The positioning member 32 is slidably disposed in the installation notch 122 and pushes the claw 20, so that the claw 20 normally moves toward the first tip 13. The elastic member 31 is a compression spring, and the positioning member 32 is a hollow pin formed of metal material. In the first embodiment, the elastic member 31 and the positioning member 32 are arranged in a coaxial alignment. The positioning member 32 has a body portion 321, and the body portion 321 is slidably disposed in the installation notch 122 and comprises an inner bore 322 whose sectional face is formed in a circular shape. Also, the positioning member 32 has a hemisphere shaped resisting end 323 formed on one end in opposite to the inner bore 322 and connected with the body portion 321. The positioning area 33 is an arc shaped groove formed on the claw 20 and faces one side of the main body 10. Also, elastic member 31 comprises a pushing end 311 and an inner end 312. The pushing end 311 pushes the inner bore 322 of the positioning member 32, and the inner end 312 contacts the installation notch 122.

Figure 5:
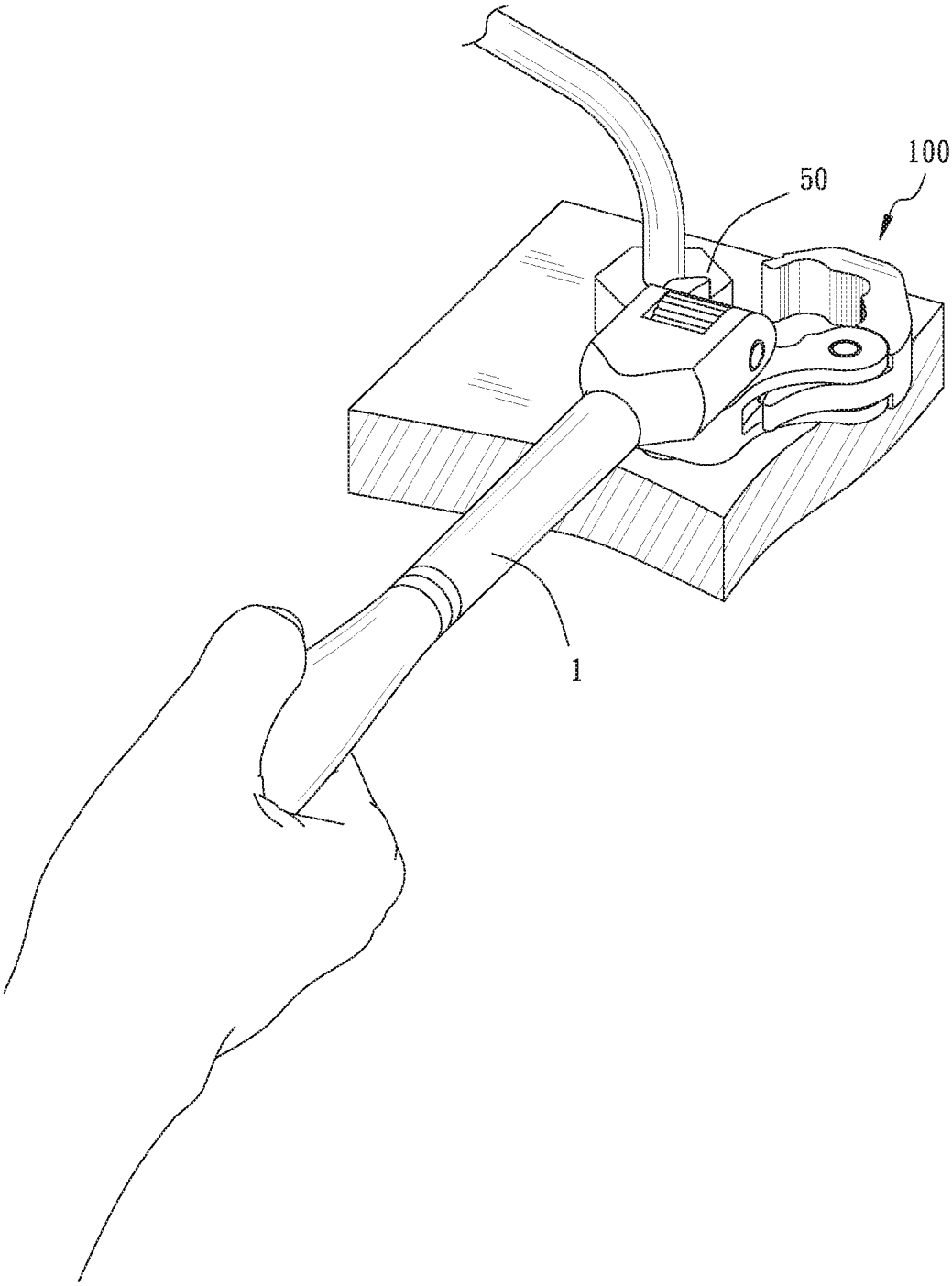
FIG. 5 is a schematic view of the reciprocating wrench for quick combining fastener in accordance with the first embodiment of the present invention, illustrating the wrench in the opening status, with the hand of the user griping the hand tool to approach the fastener of the oil-pipe.

The elastic positioning device 30 is disposed between the main body 10 and the claw 20, such that the claw 20 is able to rotate toward the closing direction for the wrench 100 to combine the fastener 50. When the press member 24 is pressed by the fingers of the user or other external force, the claw 20 is allowed to rotate toward the opening direction until the positioning member 32 of the elastic positioning device 30 resisting against the positioning area 33 for generating a first force F1 and a second force F2 imposed upon the positioning face 331 of the positioning area 33. A torque M1 generated by the first force F1 upon the pivot center C offsets a obverse torque M2 generated by the second force F2 upon the pivot center C (i.e. the torque M1 being equal to the obverse torque M2), such that the elastic positioning device 30 resists against the positioning face 331 of the positioning area 33 to reach a force balancing status. Therefore, the claw 20 is at the first position and remains open with respect to the main body 10, as shown by FIG. 4. In other words, the force imposed by the positioning member 32 of the elastic positioning device 30 upon the positioning area 33 is completely transmitted to the pivot center C through the positioning face 331, so that the claw 20 remains in the opening status. At the same time, the wrench 100 is able to easily and conveniently approach the peripheral area of the oil-pipe, as shown by FIG. 5.

Figure 6:
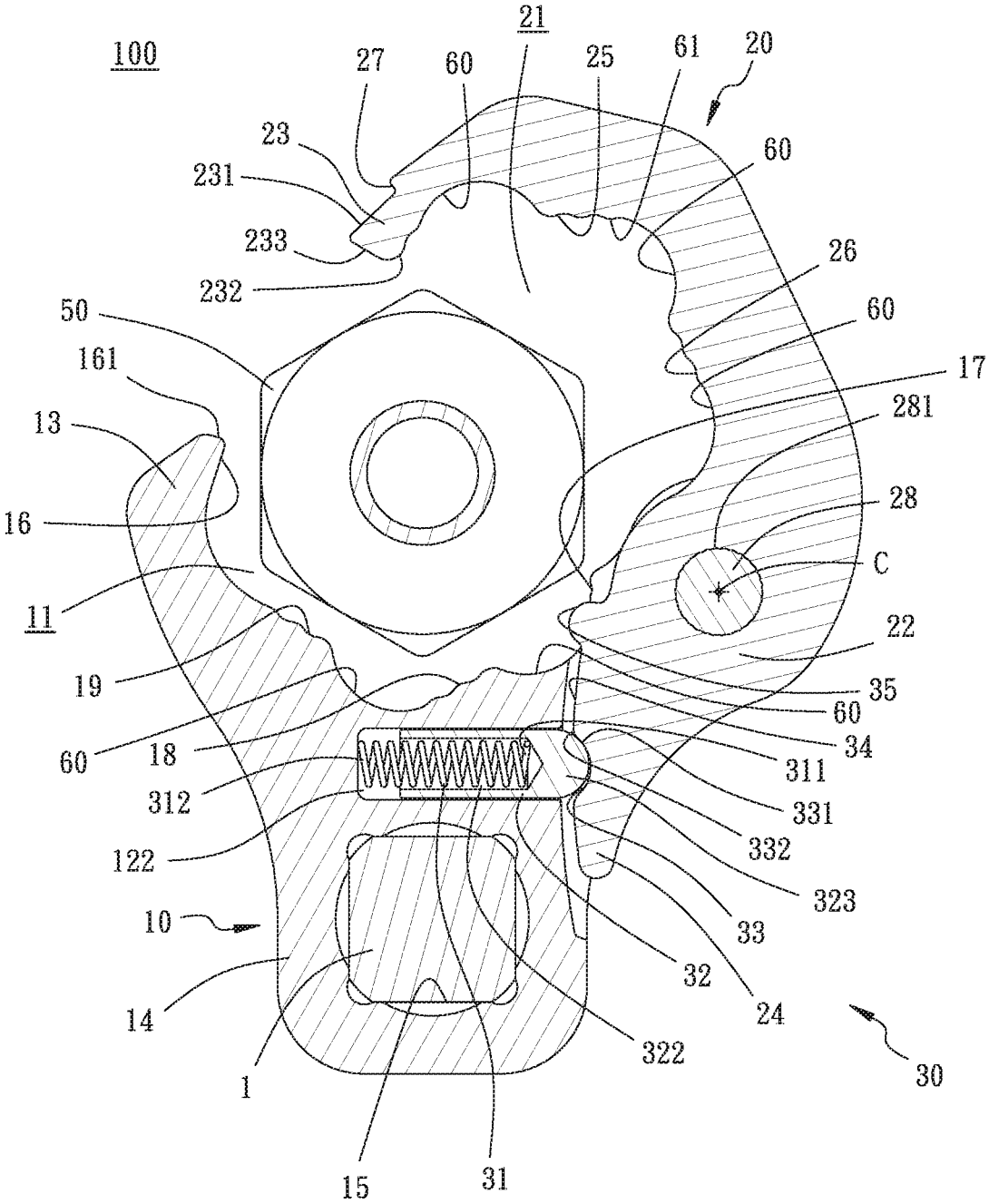
FIG. 6 is a schematic view of the reciprocating wrench for quick combining fastener in accordance with the first embodiment of the present invention, illustrating the wrench combining the fastener in the two jaw openings.

When the user needs to combine the fastener 50 with the wrench 100, as shown by FIG. 6, which means that the claw 20 leaves the opening status, the user imposes a force on the wrench 100, such as by wavering the wrench 100 or contacting the oil-pipe with the main body 10 of the wrench 100. The movement of the main body 10 causes the mass of the claw 20 to generate an inertia of rotation toward the closing direction, such that the inertia of the claw 20 surpasses the static friction between the positioning face 331 and the positioning member 32 and also the resistance of the dividing side 332, whereby the positioning member 32 crosses the dividing side 332 and slides to reach the slide area 34. As a result, the claw 20 pivots from the opening status in FIG. 6 to the closing status at the second position in FIG. 8. Briefly speaking, the user applies the inertia of the claw 20 to remove the positioning effect of the elastic positioning device 30, without the need of using the hands to approach the claw 20 near the oil-pipe, assuring the safety and convenience of usage.

Figure 7:
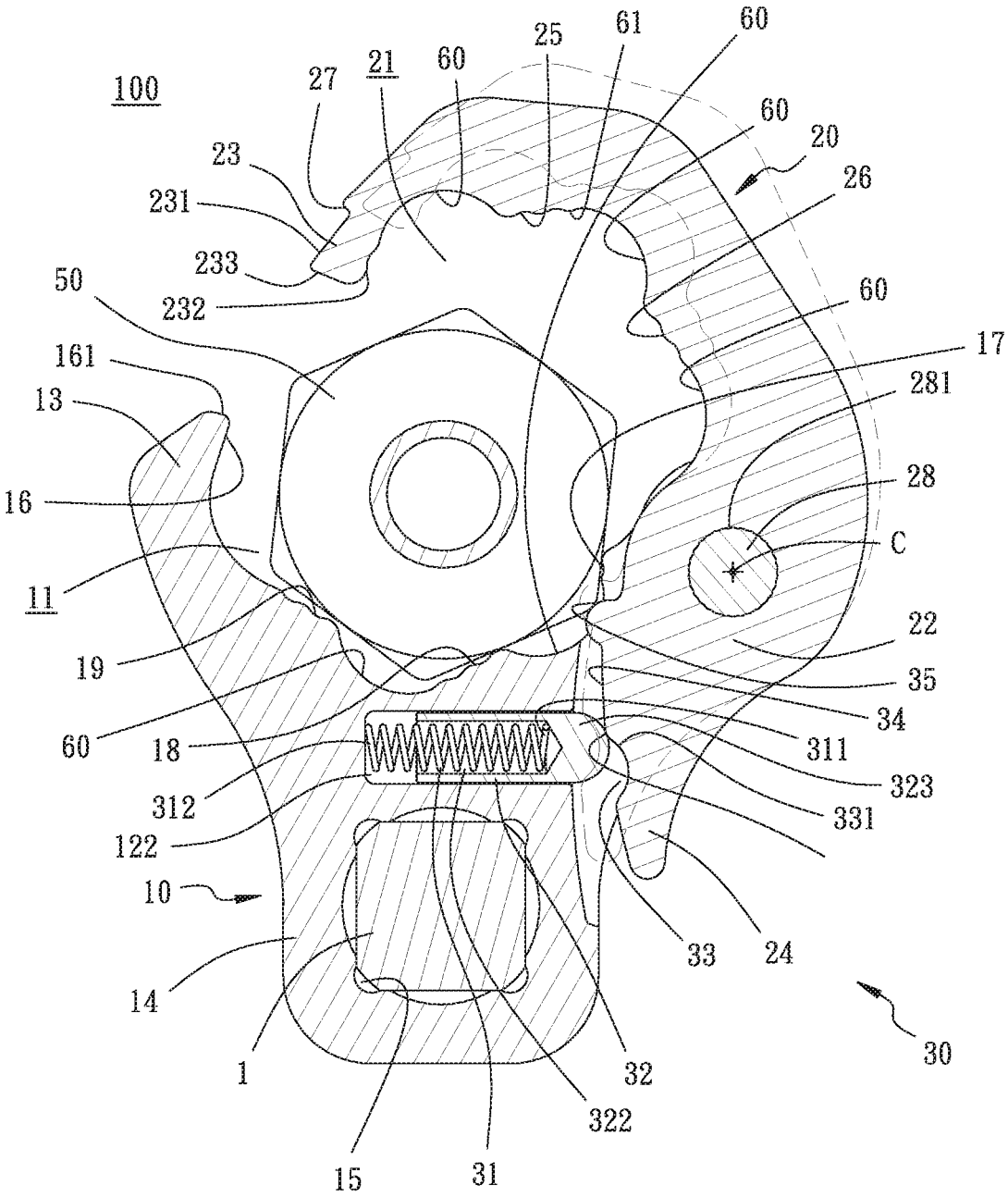
FIG. 7 is a schematic view of the reciprocating wrench for quick combining fastener, illustrating release portion resisting the third obverse force bearing face, with the claw pivoting to away from the first position.

In addition to the application of inertia for removing the opening status of the claw 20, in the first embodiment, another technique is applied to reach the identical technical effect. The elastic positioning device 30 further includes a release portion 35 disposed on the claw 20 away from the positioning are 33. At the first position, the release portion 35 protrudes from the inner side of the first jaw opening 11 with respect to the main body 10, as shown by FIG. 6. Therefore, in the opening status of the wrench 100, the user applies the release portion 35 to resist against the fastener 50 or the oil-pipe, so that the wrench 100 recovers to the second position from the first position. Referring to FIG. 7, when the claw 20 is at the first position, the user applies the release portion 35 to resist against one lateral side of the fastener 50, such that the counterforce is imposed upon the claw 20. As a result, the claw 20 pivots about the pivot center C to rotate toward the closing direction, so that the positioning member 32 of the elastic positioning device 30 crosses the dividing side 332 from the positioning area 33 and slides to reach the slide area 34. Therefore, the claw 20 pivots from the first position to the second position, achieving the closing status with respect to the main body 10, so as to be engaged with the fastener 50, as shown by FIG. 8.

Furthermore, a position limiting portion 27 protrudes on one side of the claw 20 adjacent to the outer retaining face 231. When the wrench 100 is not engaged with the fastener 50, the position limiting portion 27 is applied for resisting against the first connection face 161 of the first tip 13, so that a space surrounded by the first jaw opening 11 and the second jaw opening 21 is smaller than the outer profile of the fastener 50.

Referring to FIG. 5 to FIG. 10, the operation theory and effect of the wrench 100 of the first embodiment are illustrated. As shown by FIG. 5 and FIG. 6, before the fastening operation of the fastener 50 on the oil-pipe, the combination bore 15 of the wrench 100 is combined with the hand tool 1, and the user presses the press member 24 of the claw 20, thereby pivoting the claw 20 to the first position. At the meantime, the positioning member 32 of the elastic positioning device 30 resists against the positioning area 33, so that the claw 20 remains in the opening status. Therefore, when the wrench 100 approaches the peripheral space of the oil-pipe, the user only needs to grip the distal end of the hand tool 1 with one hand and move the first jaw opening 11 and the second jaw opening 21 of the wrench 100 to the peripheral space of the oil-pipe, and then axially moves the first jaw opening 11 and the second jaw opening 21 along the oil-pipe, so as to position the first jaw opening 11 and the second jaw opening 21 of the wrench 100 to the peripheral space of the fastener 50.

Figure 9:
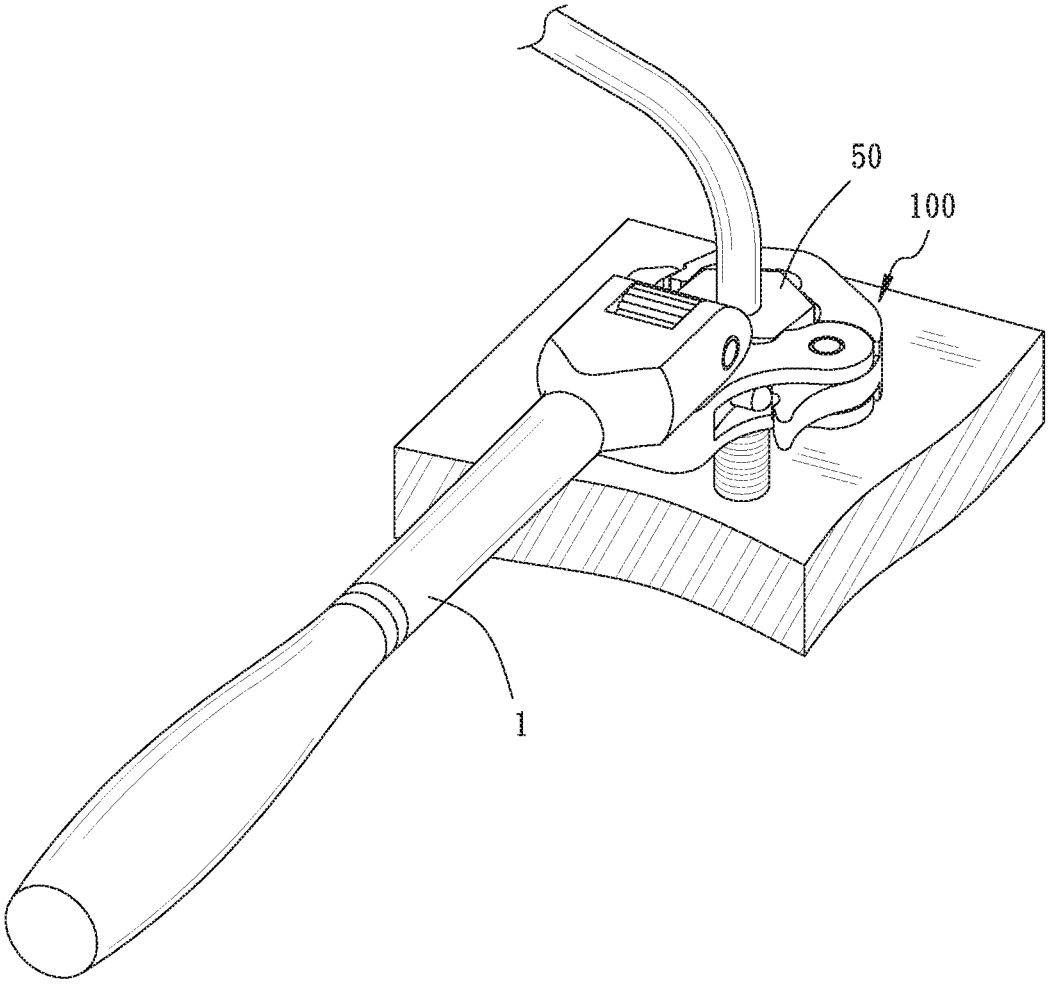
FIG. 9 is a schematic view of the reciprocating wrench for quick combining fastener, illustrating the wrench completely combining the fastener on the oil-pipe.

Referring to FIG. 7, when the first jaw opening 11 and the second jaw opening 21 of the wrench 100 move to the peripheral space of the fastener 50, the release portion 35 of the wrench 100 is applied for resisting against the fastener 50, so that the claw 20 is able to pivot about the pivot center C, whereby the positioning member 32 of the elastic positioning device 30 leaves the positioning area 33 and crosses the dividing side 332 to reach the slide area 34, and the claw 20 accordingly pivots to the second position. Alternatively, the user may achieve the identical effect by use of the inertia function, without the need of applying another hand for operating the wrench 100. Therefore, the issue of the operation in an uneasily reached narrow space is resolved. Also, when combining the fastener 50 with the wrench 100, the user does not need to continuously press the claw 20 for a long time As shown by FIG. 8 and FIG. 9, when the wrench 100 is completely engaged with the fastener 50, the first forcing face 17, second forcing face 18, and third forcing face 19 of the main body 10 face the fourth force bearing face 54A, third force bearing face 53A, and second force bearing face 52A of the fastener 50, respectively; the inner retaining face 232 of the claw 20 faces the first force bearing face 51A; the fourth forcing face 25 and fifth forcing face 26 of the claw 20 face the sixth force bearing face 56A and fifth force bearing face 55A of the fastener 50. Therefore, the fastener 50 is engaged in the first jaw opening 11 and the second jaw opening 21.

Figure 10:
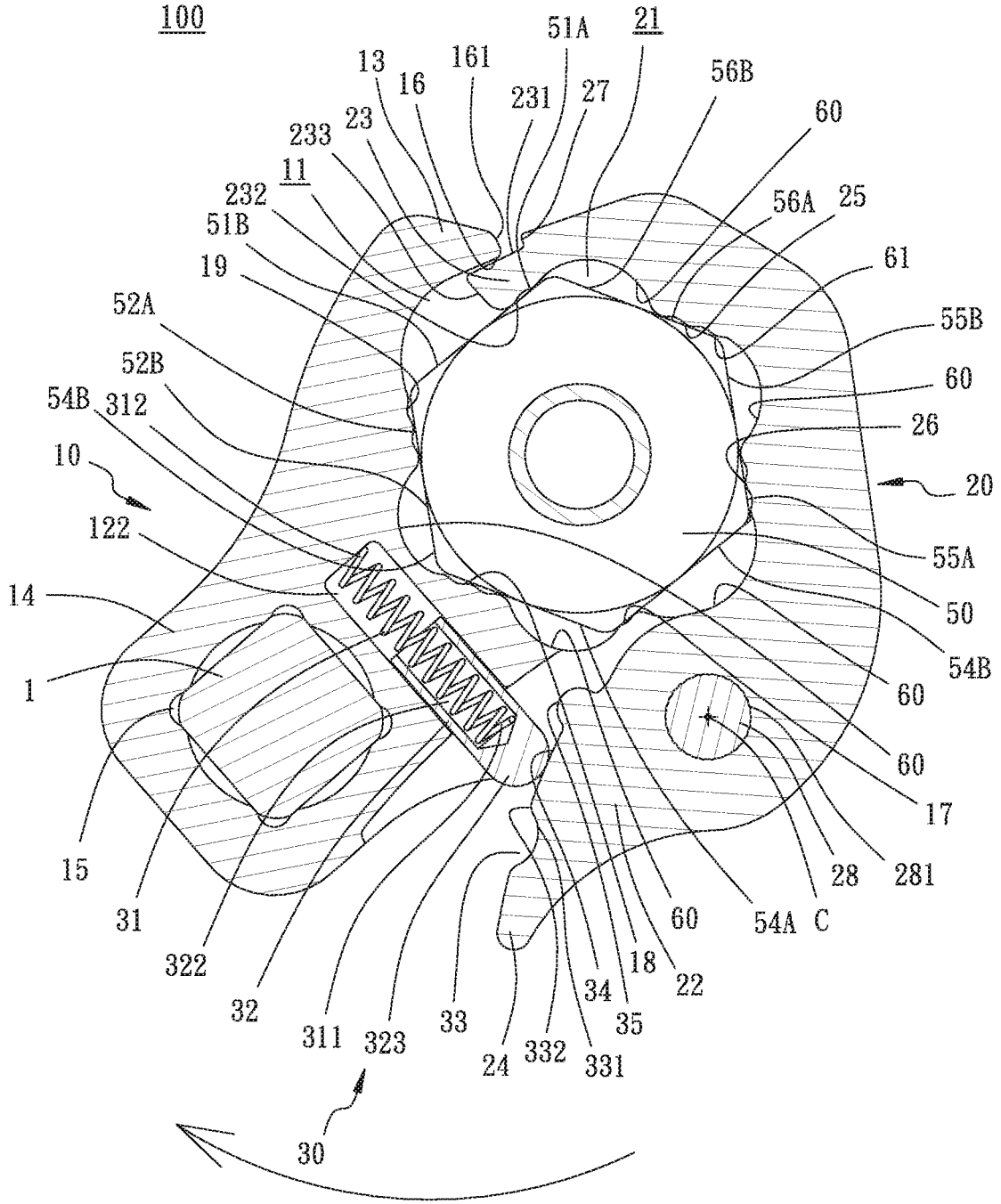
FIG. 10 is a schematic view of the reciprocating wrench for quick combining fastener, illustrating the fastener being driven to rotate in a clockwise direction.

As shown by FIG. 10, the reciprocating wrench 100 for quick combining fastener 50 is in a status of screwing the fastener 50 in a clockwise direction. Currently, the wrench 100 drives the fastener 50 to rotate about the rotation center X. The force imposed by the user is transmitted through the block face 16 and the second tip 23 to the first force bearing face 51A of the fastener 50. At the same time, the force imposed by the user is also transmitted through the first forcing face 17, second forcing face 18, third forcing face 19, fourth forcing face 25, and the fifth forcing face 26 to the fourth force bearing face 54A, third force bearing face 53A, second force bearing face 52A, sixth force bearing face 56A, and fifth force bearing face 55A of the fastener 50, so as to screw the fastener 50. Due to an evenly imposed force born by the fastener 50, the wrench 100 is allowed to easily drive the fastener 50 to rotate on the thread.

When the user wishes to efficiently reciprocate the wrench 100, the user does not have to detach the wrench 100 from the fastener 50 along the axial direction of the oil-pipe. Instead, the main body 10 rotationally reciprocates about the rotation center X, so that the claw 20 reciprocates due to the sliding reciprocation of the positioning member 32 of the elastic positioning device 30 on the slide area 34. Therefore, the user is allowed to repeatedly wrench the fastener 50 until the fastener 50 is screwed to the target fastened position.

Figure 11:
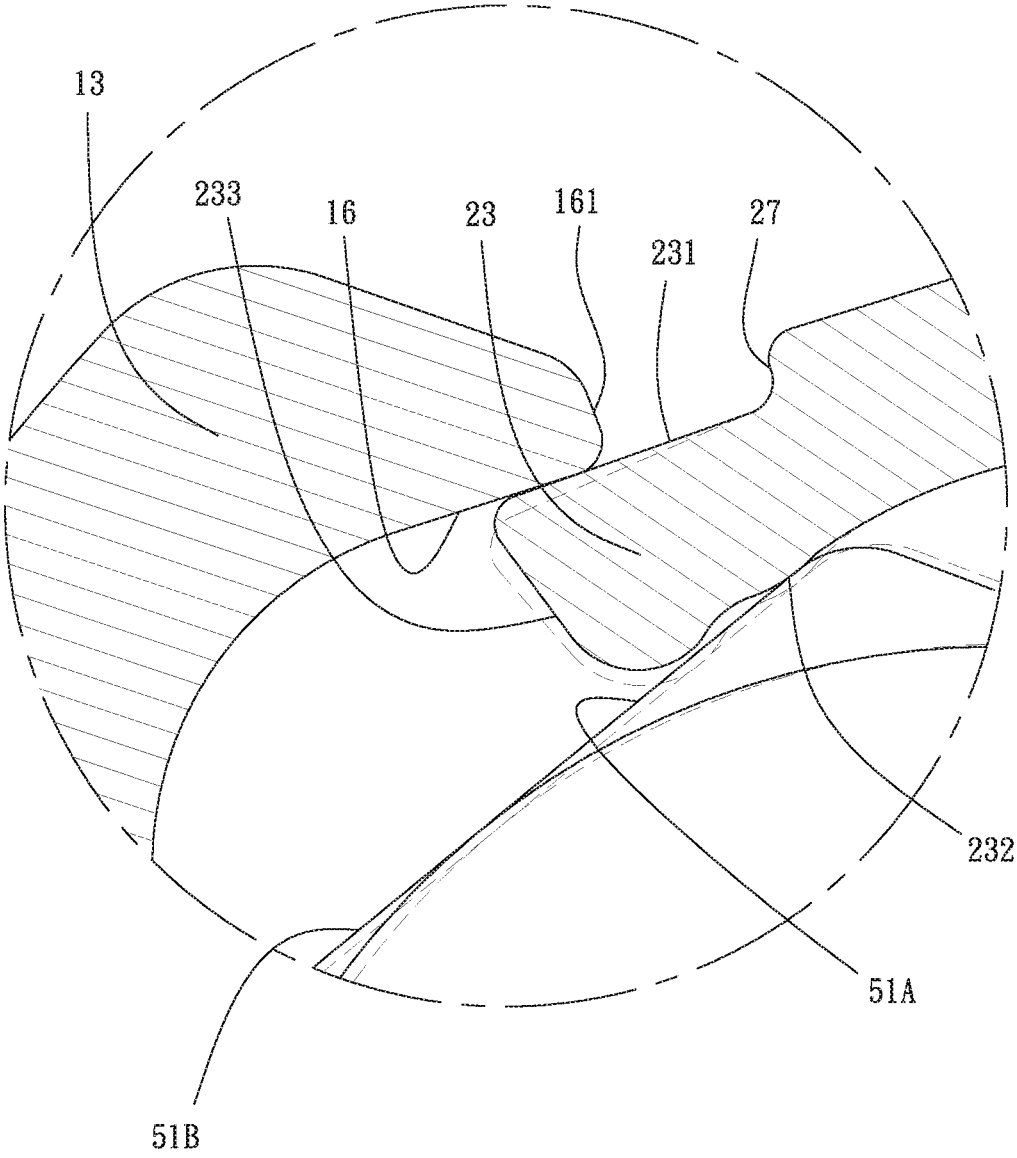
FIG. 11 is an enlarged view of the reciprocating wrench for quick combining fastener, illustrating the second tip elastically expanding to resist against the first tip after the fastening process.

Referring to FIG. 11, when the fastener 50 is screwed to the target fastened position, the user may carry out the final fastening operation. The user keeps imposing the force upon the fastener 50 through the wrench 100, so that the torque value of the wrench 100 continuously increases. The distance between the first tip 13 and the neighboring first force bearing face 51A of the fastener 50 decreases along a direction in opposite to the expansion direction of the claw 20 with respect to the first tip 13. The largest width of the distal end of the second tip 23 is greater than the smallest distance between the first tip 13 and the neighboring first force bearing face 51A of the fastener 50. Therefore, the counterforce of the first force bearing face 51A of the fastener 50 forces the second tip 23 to resiliently expand to resist against the first tip 13; in other words, the second tip 23 bears the counterforce to resist against the first tip 13, such that the second tip 23 of the claw 20 is resisted and blocked by the first tip 13 and prevented from detachment. As a result, at the fastened position, the second tip 23 is effectively resisted against the first tip 13, such that the claw 20 is prevented from separation and detachment with respect to the main body 10, facilitating the high-torque fastening operation. Even if the wrench 100 is applied in a high-torque fastening situation other than an oil-pipe worksite, the wrench 100 is still able to be stably engaged with the fastener 50 are prevented from detachment.

Figure 12:
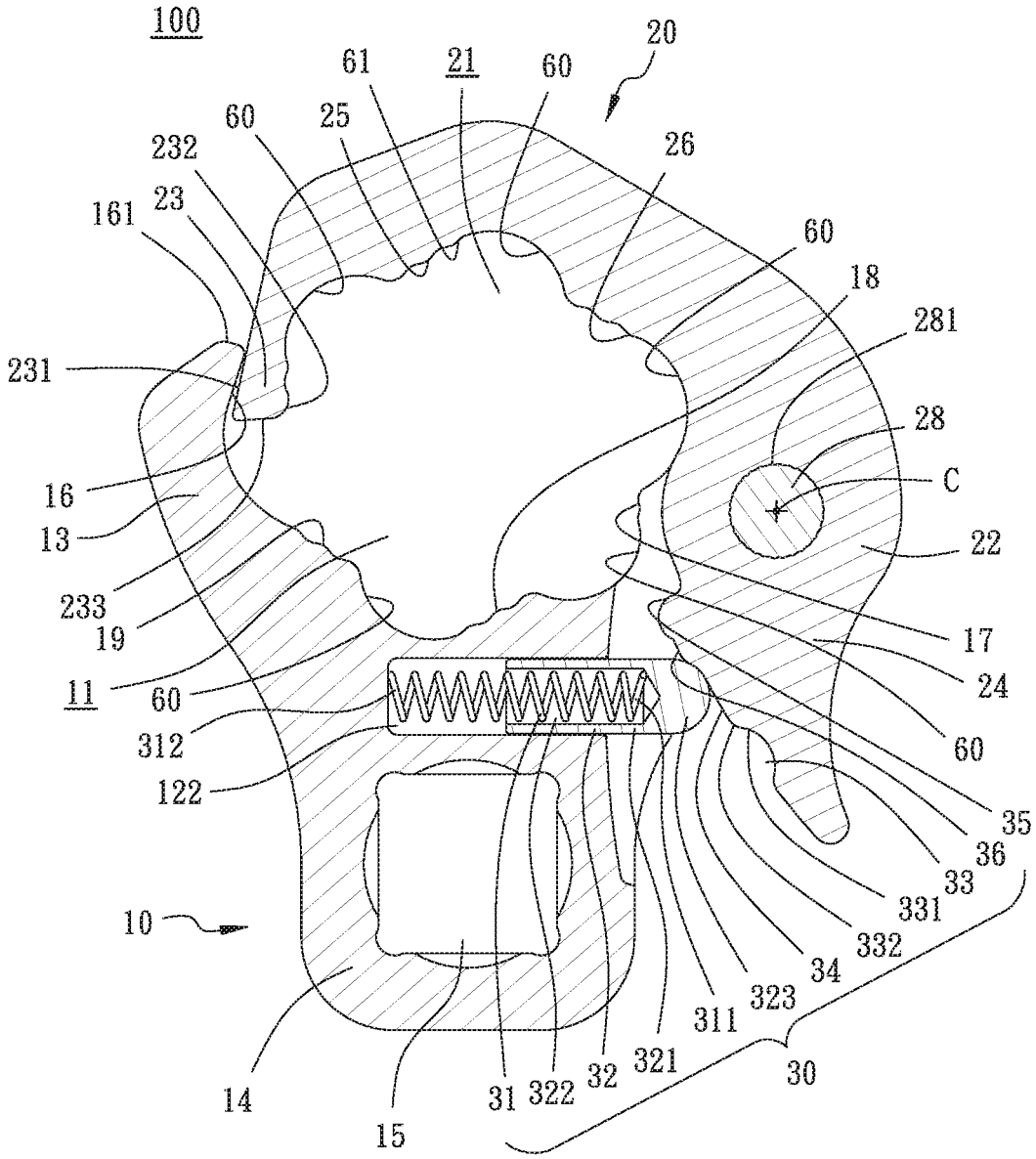
FIG. 12 is a transverse sectional view of the reciprocating wrench for quick combining fastener in accordance with a second embodiment of the present invention, illustrating the positioning member of the elastic positioning device resisting against the position limiting area, with the claw facing the closing direction.

Referring to FIG. 12, a second embodiment of the present invention is illustrated. The numeric representing similar or identical components, structures, and functions of the present invention in the first embodiment are herein saved.

Figure 13:
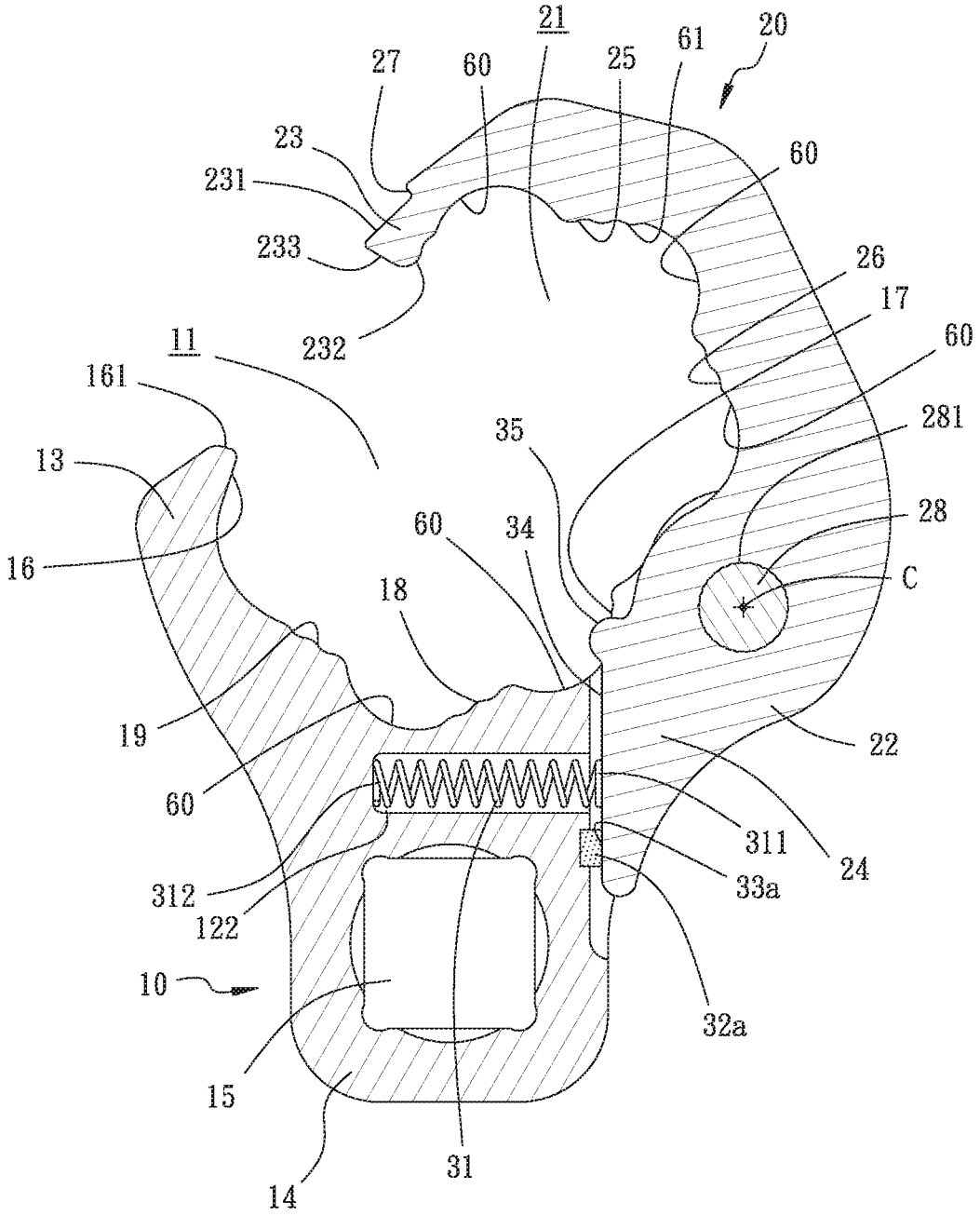
FIG. 13 is a transverse sectional view of the reciprocating wrench for quick combining fastener in accordance with a third embodiment of the present invention, illustrating the positioning member which is a magnet disposed between the claw and the main body, with the claw at the first position.

In the second embodiment, the elastic positioning device 30 further includes a position limiting area 36, which is disposed on the claw 20 away from the positioning area 33 and in adjacent to the slide area 34. When the positioning member 32 of the elastic positioning device 30 resists against the position limiting area 36, the space surrounded by the first jaw opening 11 and the second jaw opening 21 is smaller than the outer profile of the fastener 50, and achieves an identical function with the position limiting portion 27. Referring to FIG. 13, a third embodiment of the present invention is illustrated. The difference of the third embodiment compared with the first embodiment lies in that the elastic positioning device 30 includes an elastic member 31, a positioning member 32*a*, and a positioning are 33*a* which is formed on the claw 20. The elastic member 31 is disposed on the main body 10 and provides the elastic recovering force for the claw 20 to rotate toward the closing direction. The positioning member 32*a* is disposed between the main body 10 and the claw 20, and optionally positioned on the positioning area 33*a* for optionally maintaining the claw 20 in the opening status. The slide area 34 is formed on one side of the positioning area 33*a* to be pushed by the elastic member 31 and generate a sliding relationship with respect to the elastic member 31. The installation notch 122 is disposed on the pivot end 12 of the main body 10 and opens toward the claw 20. The elastic member 31 is received in the installation notch 122 for pushing the claw 20, such that the claw 20 normally moves toward the first tip 13. The elastic member 31 is a compression spring disposed between the main body 10 and the claw 20. The positioning member 32*a* is a magnet disposed on the main body 10. The positioning area 33*a* is formed of a magnetic material and disposed on the claw 20 and faces one side of the main body 10. The positioning member 32*a* is able to overcome the elastic recovering force imposed by the elastic member 31 upon the claw 20 to be magnetically attached to the positioning area 33*a*, such that a magnetic positioning effect is generated between the positioning member 32*a* and the positioning area 33*a*. The elastic member 31 includes the pushing end 311 and the inner end 312, wherein the pushing end 311 pushes the claw 20, and the inner end 312 resists against the installation notch 122. The elastic member 31 and the positioning member 32*a* are not disposed in a coaxial alignment and not at an identical position. In the third embodiment, the inertia of the claw 20 is applied for removing the positioning effect of the elastic positioning device 30. Therefore, the user does not need to approach the claw 20 which is in the peripheral space of the oil-pipe by hand, assuring the safety and convenience of usage. Besides the application of the inertia technique, the opening status of the claw 20 is also allowed to be removed by use of the release portion 35.

Figure 14:
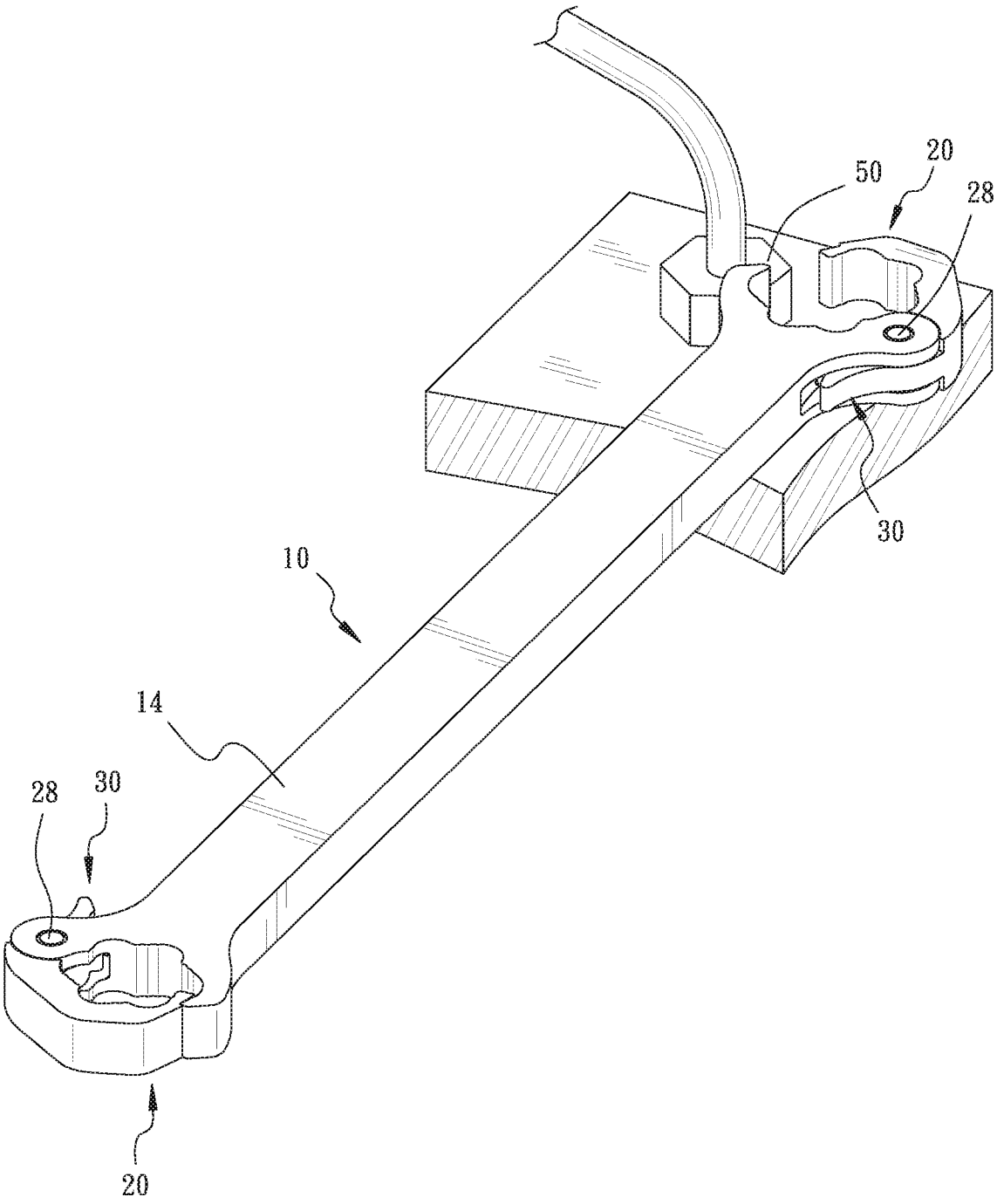
FIG. 14 is a schematic view of the reciprocating wrench for quick combining fastener in accordance with a fourth embodiment of the present invention, illustrating the wrench being a double-headed wrench, with the operation portion being a long handle.

Referring to FIG. 14, a fourth embodiment of the present invention is illustrated. The operation portion 14 is a handle, allowing the user to directly grip the operation portion 14 to wrench the main body 10 without applying additional tools. Also, the wrench 100 is allowed to have a double-headed structure for enhancing the utility of usage. Further, the double-headed wrench 100 is applicable to operation sites other than an oil-pipe, achieving a widely applicable feature which is popular among customers.

Thus, the reciprocating wrench 100 for quick combining fastener 50 in accordance with the embodiments of the present invention is convenient for combining the fastener 50 without the need of continuously pressing the claw 20 for maintaining the opening status, so that the wrench 100 is easily move to the position close to the fastener 50 for combining the fastener 50. Therefore, the inconvenience of operation in a narrow space and the difficulty of continuously pressing the claw 20 are resolved, and the safety and convenience of usage for the user in a high-temperature oil-pipe operation environment are thereby improved.

Furthermore, the present invention achieves a quick reciprocating operation. During the fastening operation, the claw 20 is prevented from separation and detachment with respect to the main body 10, so as to assure that the main body 10 and the claw 20 are stably engaged with the fastener 50 and realize a stable high-torque fastening operation.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A reciprocating wrench for quick combining fastener, comprising:

a main body comprising a concavely-shaped first jaw opening, the first jaw opening comprising a pivot end on one side thereof;

a claw comprising a concavely-shaped second jaw opening, the second jaw opening comprising a pivotal combination portion on one side thereof, the pivotal combination portion of the claw being pivotally connected with the pivot end of the main body along a pivot center, such that the claw pivotally moves with the pivot center as a rotation center in order to optionally rotate toward a closing direction or an opening direction;

a press member; and an elastic positioning device disposed between the main body and the claw, the elastic positioning device including an elastic member, a positioning member, and a positioning area, the elastic member being disposed on the main body, the positioning member being disposed between the main body and the claw, wherein the reciprocating wrench is configured such that upon a force being applied on the press member, the claw is rotated towards the opening direction until the positioning member rests against the positioning area, and such that while the positioning member rests against the positioning area, the force is removed, and the claw remains in an opening status by means of the positioning member being positioned on the positioning area, and when a force is imposed on the main body, the positioning member leaves the positioning area enabling the elastic member to allow the claw to rotate toward the closing direction.

2. The wrench of claim 1, wherein the claw and the main body pivot with respect to each other between a first position and a second position; when the claw is at the first position, the claw remains in the opening status with respect to the main body; when the claw is at the second position, the claw is in a closing status with respect to the main body.

3. The wrench of claim 2, wherein at the first position, the positioning member resists against the positioning area, so as to generate a first force and a second force; a torque generated by the first force upon the pivot center offsets a obverse torque generated by the second force upon the pivot center, such that the claw remains in the opening status.

4. The wrench of claim 3, wherein the elastic positioning device includes a slide area formed on one side of the positioning area to be pushed by the elastic member and generate a sliding relationship with respect to the positioning member; the positioning area is an arc shaped groove; the positioning area includes a positioning face and a dividing side formed on one side of the positioning face; a distance from the positioning face to the pivot center is smaller than a distance from the dividing side to the pivot center; when the claw pivots from the first position to the second position, the positioning member crosses the dividing side to resist against the slide area.

5. The wrench of claim 4, wherein the main body has an installation notch facing the claw; the elastic member is disposed in the installation notch and pushes the positioning member, and the positioning member is slidably disposed in the installation notch and pushes the claw; the elastic member is a compression spring, and the positioning member is a hollow pin formed of a metal material; the positioning member has a body portion on one end thereof; the body portion is slidably disposed in the installation notch and comprises an inner bore whose sectional face is formed in a circular shape; the positioning member has a hemisphere shaped resisting end formed on one end thereof in opposite to the inner bore and connected with the body portion; the elastic member comprises a pushing end and an inner end; the pushing end pushes the inner bore of the positioning member, and the inner end contacts the installation notch.

6. The wrench of claim 4, wherein the elastic positioning device further comprises a position limiting area disposed on the claw away from the position limiting area and in adjacent to the slide area; when the positioning member resists against the position limiting area, a space surrounded by the first jaw opening and the second jaw opening is smaller than an outer profile of the fastener.

7. The wrench of claim 2, wherein a slide area is formed on one side of the positioning area to be pushed by the elastic member and generate a sliding relationship with respect to the elastic member; the elastic member is a compression spring disposed between the main body and the claw; the positioning member is a magnet disposed on the main body; the positioning area is formed of a magnetic material and disposed on the claw and faces one side of the main body; the positioning member is able to overcome the elastic recovering force imposed by the elastic member upon the claw to be magnetically attached to the positioning area, such that a magnetic positioning effect is generated between the positioning member and the positioning area.

8. The wrench of claim 2, wherein the first jaw opening has a first tip on one side thereof in opposite to the pivot end; the second jaw opening has a second tip on one side thereof in opposite to the pivotal combination portion; when the claw is at the second position and the wrench is engaged with the fastener in a fastening operation, the fastener is positioned in the first jaw opening and the second jaw opening; a distance between the first tip and a neighboring first force bearing face of the fastener decreases in a direction in opposite to an expansion direction of the claw with respect to the first tip; a largest width of a distal end of the second tip is greater than a smallest distance between the first tip and the neighboring first force bearing face of the fastener; a counterforce of the first force bearing face of the fastener forces the second tip to expand to resist against the first tip.

9. The wrench of claim 8, wherein the second tip comprises an outer retaining face and an opposite inner retaining face; a longest distance between the outer retaining face and the pivot center is defined as a first radius, and a shortest distance between the inner retaining face and the pivot center is defined as a second radius, wherein the first radius is larger than the second radius; when the wrench is not engaged with the fastener, the first radius is smaller than a shortest distance between the first tip and the pivot center; when the wrench is engaged with the fastener during the fastening operation, the second tip resiliently expands, such that the longest distance between the outer retaining face and the pivot center is greater than the shortest distance between the first tip and the pivot center.

10. The wrench of claim 9, wherein the pivotal combination portion of the claw is pivotally connected with the pivot end of the main body through a single trunnion; the first tip has a block face; the first jaw opening of the main body has a first forcing face, a second forcing face, and a third forcing face sequentially disposed in a clockwise direction from one side of the block face; when the wrench is engaged with the fastener, the block face faces the outer retaining face of the claw; the first forcing face, the second forcing face, and the third forcing face face a fourth force bearing face, a third force bearing face, and a second force bearing face of the fastener, respectively; the press member extends to be formed on the pivotal combination portion of the claw; the inner retaining face faces the first force bearing face of the fastener; the claw comprises a fourth forcing face and a fifth forcing face which face a sixth force bearing face and a fifth force bearing face of the fastener, respectively; a first inclination angle is included by the block face and the first force bearing face, and a second inclination angle is included by the outer retaining face and the first force bearing face, and the second inclination angle is smaller than the first inclination angle; the block face and the first force bearing face form a block effect with the second tip, so as to prevent the second tip from detaching with respect to the block portion.

11. The wrench of claim 10, wherein a position limiting portion protrudes on one side of the claw adjacent to the outer retaining face; when the wrench is not engaged with the fastener, the position limiting portion resists against the block portion.

12. The wrench of claim 10, further comprising a first imaginary line and a second imaginary line; the first imaginary line passes through the pivot center, a rotation center of the fastener, the second tip, and the first tip; the second imaginary line passes through the first imaginary line and the rotation center of the fastener; the main body comprises an operation portion formed on a position away from the first jaw opening; the operation portion comprises a combination bore; the combination bore passes through the main body and is arranged in parallel to the rotation center of the fastener; a plurality of concaves are disposed on an inner edge of the first jaw opening and an inner edge of the second jaw opening for facing a second obverse force bearing face, a third obverse force bearing face, a fourth obverse force bearing face, the fifth obverse force bearing face, and a sixth obverse force bearing face of the fastener, respectively; each of the fourth forcing face, the fifth forcing face, and the inner retaining face comprises a plurality of skid proof grooves, respectively; each of the first forcing face, the second forcing face, and the third forcing face has a plurality of skid proof grooves, respectively; the pivot end includes two pivot ears spaced with each other, and each pivot ear comprises a first pivot hole, respectively; the claw comprises a second pivot hole, such that the trunnion passes through the two first pivot holes and the second pivot hole along the pivot center.

13. The wrench of claim 1, wherein when the claw remains in the opening status, the wrench is able to be moved, whereby a movement of the main body causes a mass of the claw to generate an inertia of rotation toward the closing direction, and the inertia of the claw is applied for removing a positioning effect of the elastic positioning device, such that the claw changes to a closing status.

14. The wrench of claim 1, wherein the elastic positioning device comprises a release portion disposed on the claw; when the claw is in the opening status, the release portion protrudes from an inner side of the first jaw opening with respect to the main body.

* * * * *